US007167567B1

(12) United States Patent
Sibbald et al.

(10) Patent No.: US 7,167,567 B1
(45) Date of Patent: Jan. 23, 2007

(54) METHOD OF PROCESSING AN AUDIO SIGNAL

(75) Inventors: Alastair Sibbald, Berkshire (GB); Fawad Nackvi, Middlesex (GB); Richard David Clemow, Bucks (GB)

(73) Assignee: Creative Technology Ltd, Singapore (SG)

( * ) Notice: Subject to any disclaimer, the term of this patent is extended or adjusted under 35 U.S.C. 154(b) by 0 days.

(21) Appl. No.: 09/367,153

(22) PCT Filed: Dec. 11, 1998

(86) PCT No.: PCT/GB98/03714

§ 371 (c)(1),
(2), (4) Date: Aug. 9, 1999

(87) PCT Pub. No.: WO99/31938

PCT Pub. Date: Jun. 24, 1999

(30) Foreign Application Priority Data

Dec. 13, 1997 (GB) ..... 97263388

(51) Int. Cl.
*H04R 5/00* (2006.01)
*H04R 5/02* (2006.01)

(52) U.S. Cl. ..... 381/17; 381/18; 381/1; 381/303; 381/310

(58) Field of Classification Search ..... 381/17, 381/1, 310, 303, 18, 74, 104, 105, 107, 309, 381/307; 369/61, 86, 97
See application file for complete search history.

(56) References Cited

U.S. PATENT DOCUMENTS 3,969,588 A * 7/1976 Raydon et al. ..... 381/307
4,910,718 A 3/1990 Horn
5,173,944 A * 12/1992 Begault ..... 381/17

(Continued)

FOREIGN PATENT DOCUMENTS

WO WO9410816 * 5/1994

(Continued)

OTHER PUBLICATIONS

Applicant's admitted prior art (p. 2 of Specification, line 23, Figure 8).*

(Continued)

*Primary Examiner*—Vivian Chin
*Assistant Examiner*—Devona E. Faulk
(74) *Attorney, Agent, or Firm*—Russell N. Swerdon

(57) ABSTRACT

A method of processing a single channel audio signal to provide an audio source signal having left and right channels corresponding to a sound source at a given direction in space, includes performing a binaural synthesis introducing a time delay between the channels corresponding to the inter-aural time difference for a signal coming from said given direction, and controlling the left ear signal magnitude and the right ear signal magnitude to be at respective values. These values are determined by choosing a position for the sound source relative to the position of the head of a listener in use, calculating the distance from the chosen position of the sound source to respective ears of the listener, and determining the corresponding left ear signal magnitude and right ear signal magnitude using the inverse square law dependence of sound intensity with distance to provide cues for perception of the distance of said sound source in use.

34 Claims, 8 Drawing Sheets

U.S. PATENT DOCUMENTS

| | | | | |
|---|---|---|---|---|
| 5,438,623 | A | 8/1995 | Begault | |
| 5,440,639 | A * | 8/1995 | Suzuki et al. | 381/17 |
| 5,500,900 | A | 3/1996 | Chen | |
| 5,521,981 | A * | 5/1996 | Gehring | 381/17 |
| 5,666,425 | A * | 9/1997 | Sibbald et al. | 381/26 |
| 5,901,232 | A * | 5/1999 | Gibbs | 381/92 |
| 5,943,427 | A * | 8/1999 | Massie et al. | 391/17 |
| 6,009,178 | A * | 12/1999 | Abel et al. | 381/1 |
| 6,009,179 | A * | 12/1999 | Wood et al. | 381/17 |
| 6,067,361 | A * | 5/2000 | Kohut et al. | 381/17 |
| 6,181,800 | B1 * | 1/2001 | Lambrecht | 381/310 |
| 6,307,941 | B1 * | 10/2001 | Tanner et al. | 381/17 |
| 6,418,226 | B2 | 7/2002 | Mukojima | |

FOREIGN PATENT DOCUMENTS

| | | |
|---|---|---|
| WO | WO9737514 | * 10/1997 |

OTHER PUBLICATIONS

Figure 8:
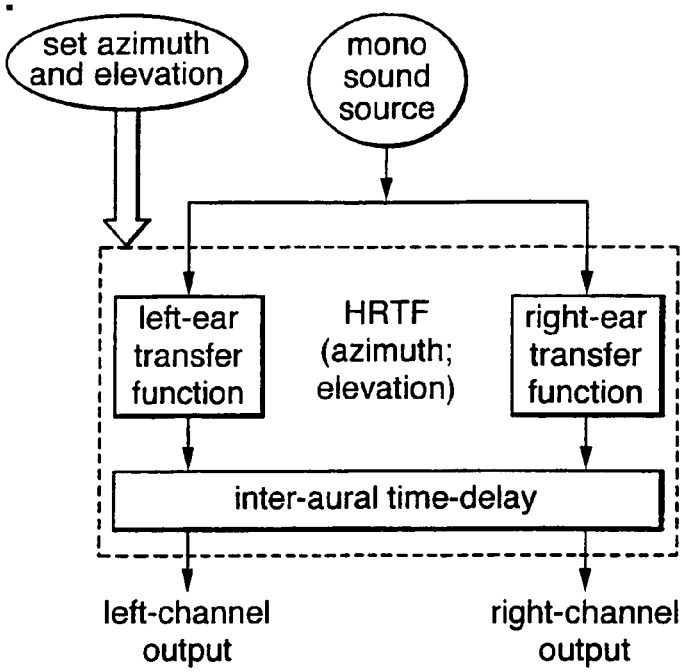

Applicant's admitted prior art, p. 2 of specification, Figure 8.*

Applicant'Admitted Prior Art, p. 2, line 23, Figure 8.*

Begault, 3D Sound for Virtual Reality and Multimedia, 1994 (See Preface), NASA Center for Aerospace Information, pp. 1-155.*

Applicant's admitted prior art, p. 2, line 23, Figure 8.*

Begault, 3D Sound for Virtual Reality and Multimedia, 1994, NASA Center for Aerospace Information, pp. 1-155.*

Brungart, Douglas S. Auditory Localization in the Near-Field. 1996 International Conference on Auditory Display.*

Duda, R. O. and Martens, W. L. (1997), range Dependence of the HRTF for a Spherical Head. Proceedings of the IEEE ASSP Workshop.*

* cited by examiner

METHOD OF PROCESSING AN AUDIO SIGNAL

This invention relates to a method of processing a single channel audio signal to provide an audio signal having left and right channels corresponding to a sound source at a given direction in space relative to a preferred position of a listener in use, the information in the channels including cues for perception of the direction of said single channel audio signal from said preferred position, the method including the steps of: a) providing a two channel signal having the same single channel signal in the two channels; b) modifying the two channel signal by modifying each of the channels using one of a plurality of head response transfer functions to provide a right signal in one channel for the right ear of a listener and a left signal in the other channel for the left ear of the listener; and c) introducing a time delay between the channels corresponding to the inter-aural time difference for a signal coming from said given direction, the inter-aural time difference providing cues to perception of the direction of the sound source at a given time.

The processing of audio signals to reproduce a three dimensional sound-field on replay to a listener having two ears has been a goal for inventors since the invention of stereo by Alan Blumlein in the 1930's. One approach has been to use many sound reproduction channels to surround the listener with a multiplicity of sound sources such as loudspeakers. Another approach has been to use a dummy head having microphones positioned in the auditory canals of artificial ears to make sound recordings for headphone listening. An especially promising approach to the binaural synthesis of such a sound-field has been described in EP-B-0689756, which describes the synthesis of a sound-field using a pair of loudspeakers and only two signal channels, the sound-field nevertheless having directional information allowing a listener to perceive sound sources appearing to lie anywhere on a sphere surrounding the head of a listener placed at the centre of the sphere.

A drawback with such systems developed in the past has been that although the recreated sound-field has directional information, it has been difficult to recreate the perception of having a sound source which is close to the listener, typically a source which appears to be closer than about 1.5 meters from the head of a listener. Such sound effects would be very effective for computer games for example, or any other application when it is desired to have sounds appearing to emanate from a position in space close to the head of a listener, or a sound source which is perceived to move towards or away from a listener with time, or to have the sensation of a person whispering in the listener's ear.

According to a first aspect of the invention there is provided a method as specified in claims 1–11. According to a second aspect of the invention there is provided apparatus as specified in claim 12. According to a third aspect of the invention there is provided an audio signal as specified in claim 13.

Figure 1:
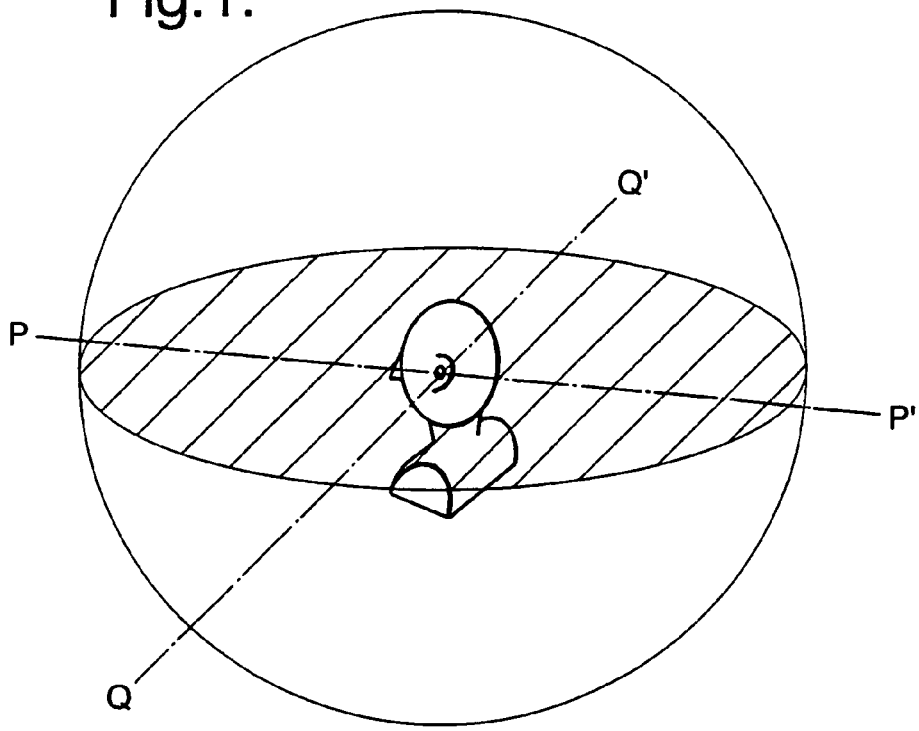
Figure 2:
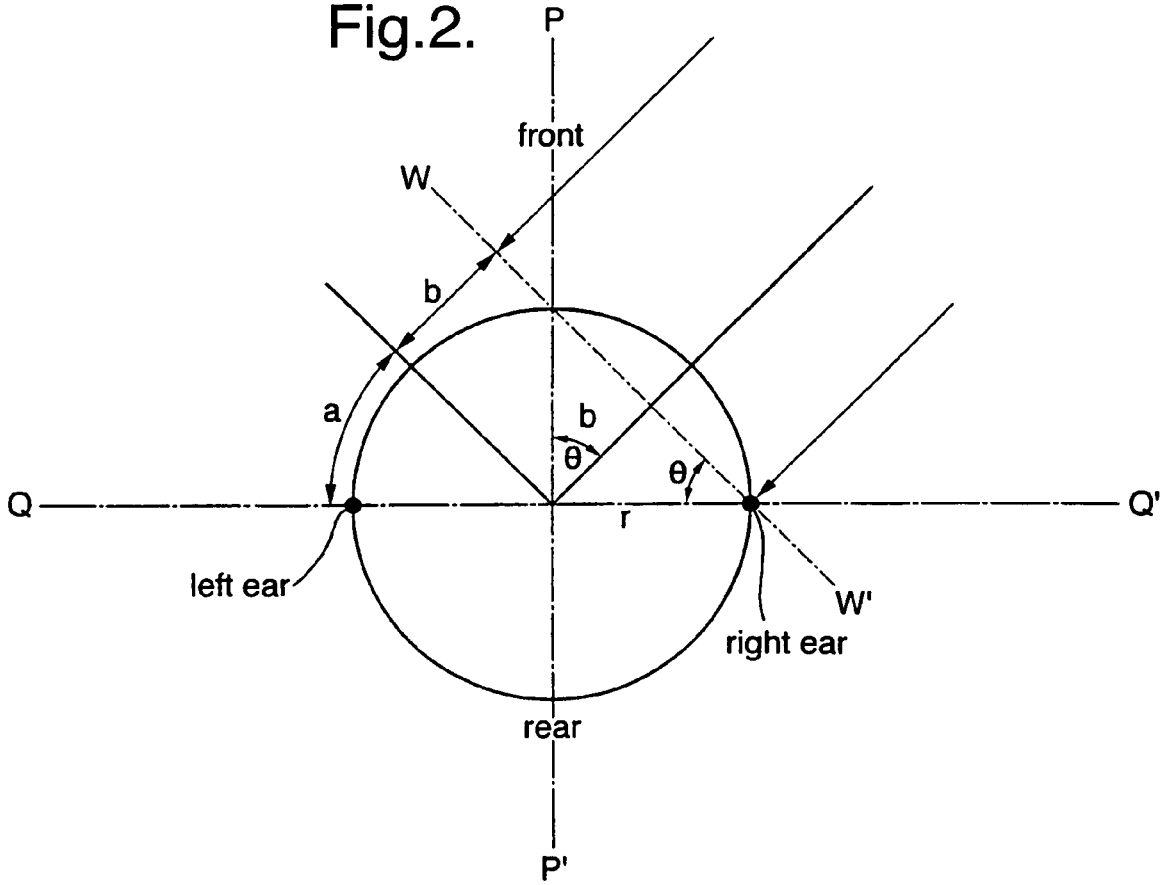
Figure 3:
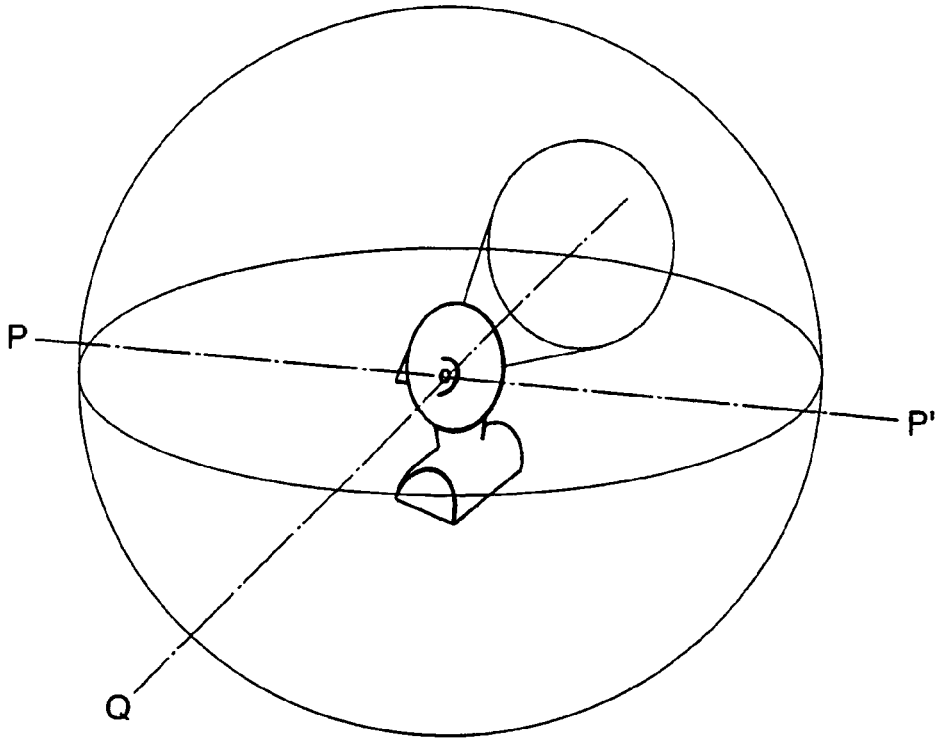
Figure 4:
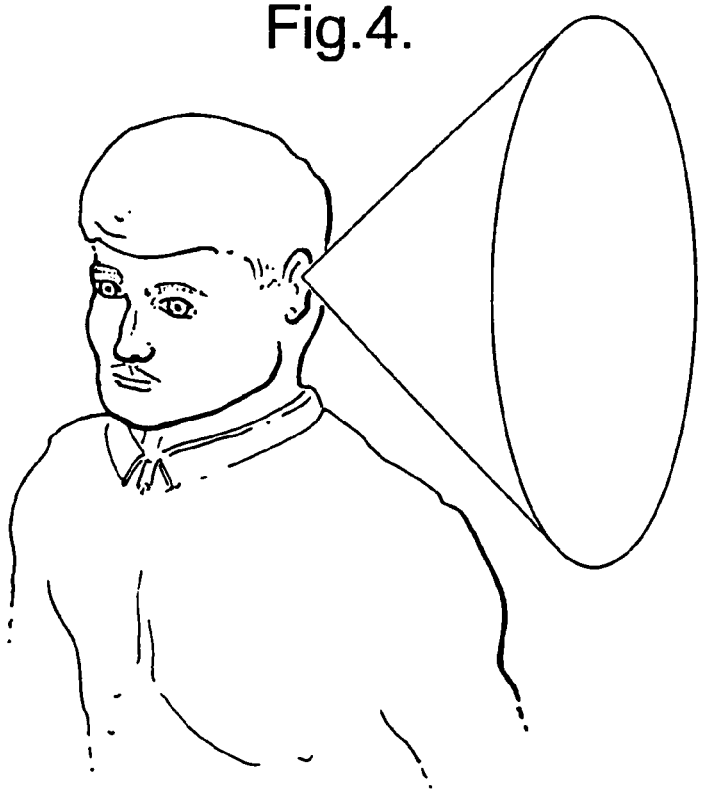
Figure 5:
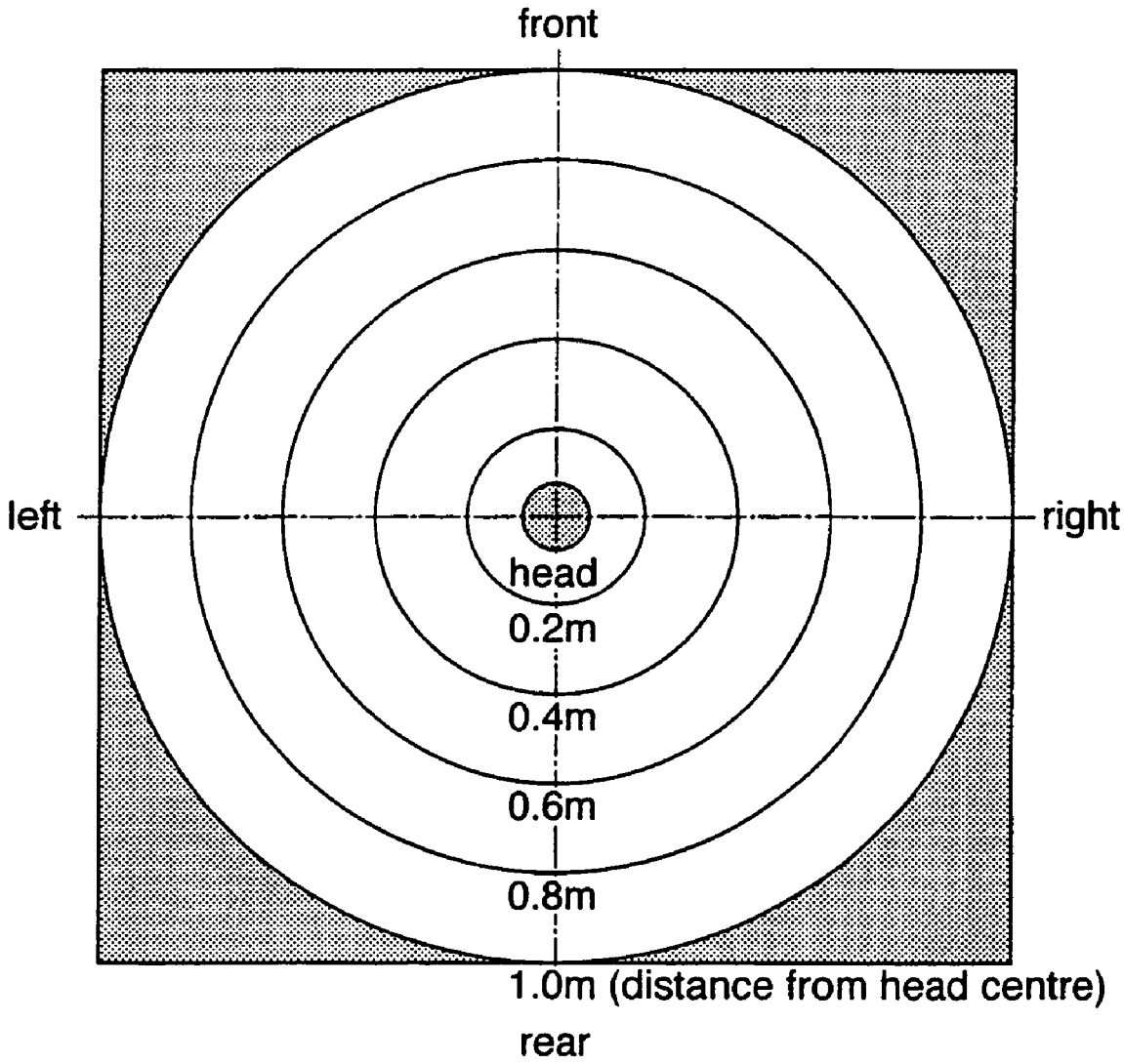
Figure 6B:
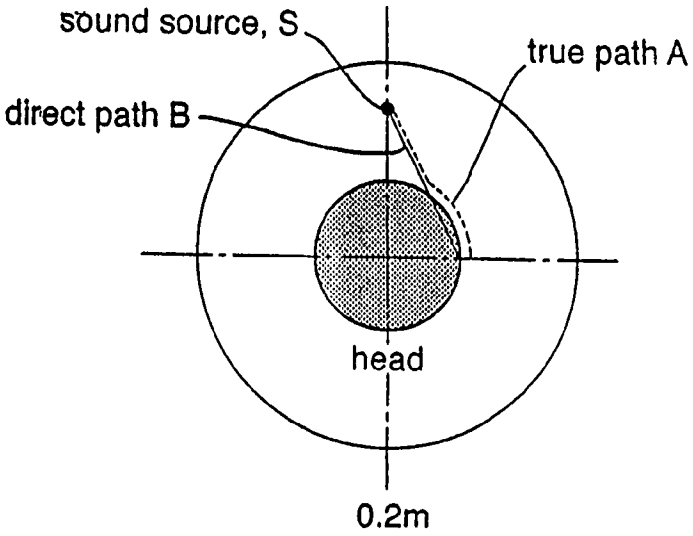
Figure 6A:
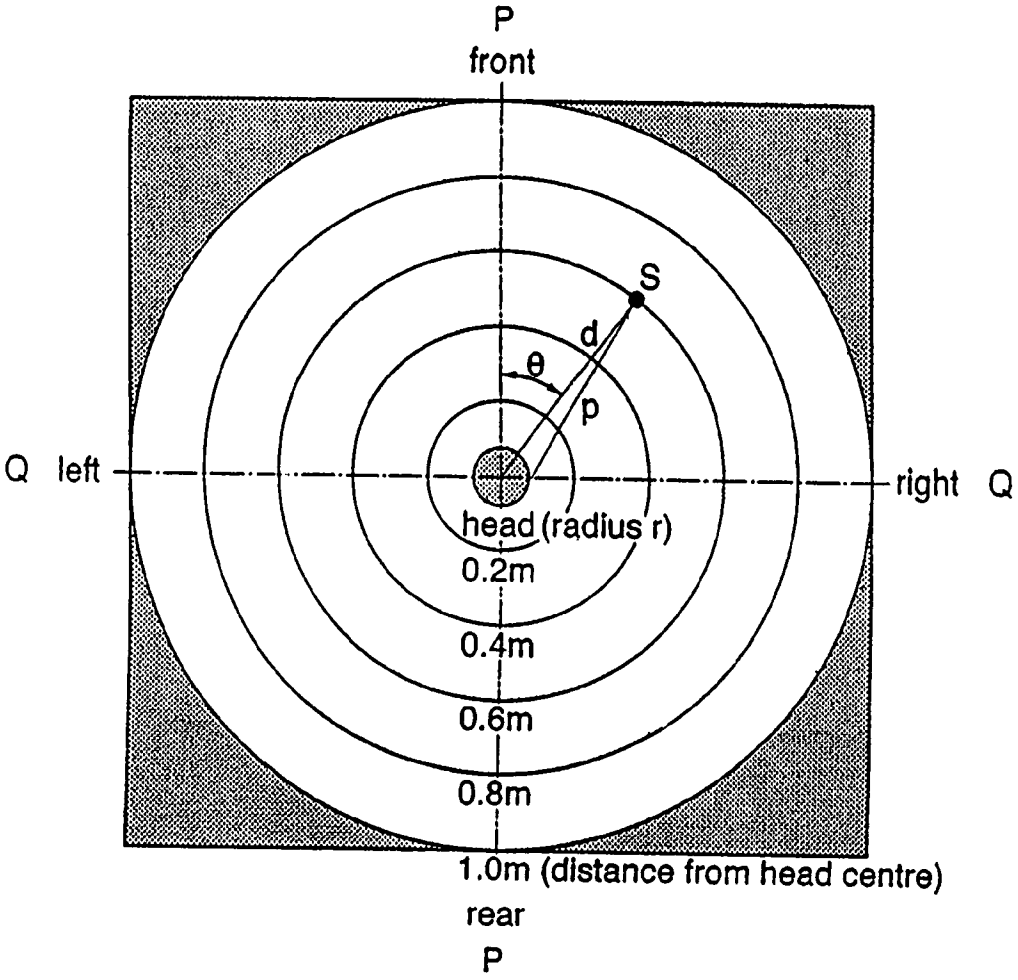
Figure 7B:
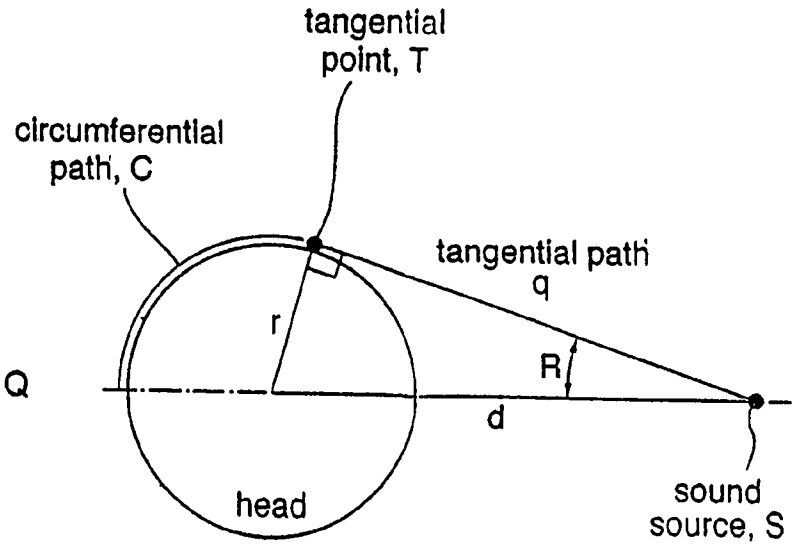
Figure 7A:
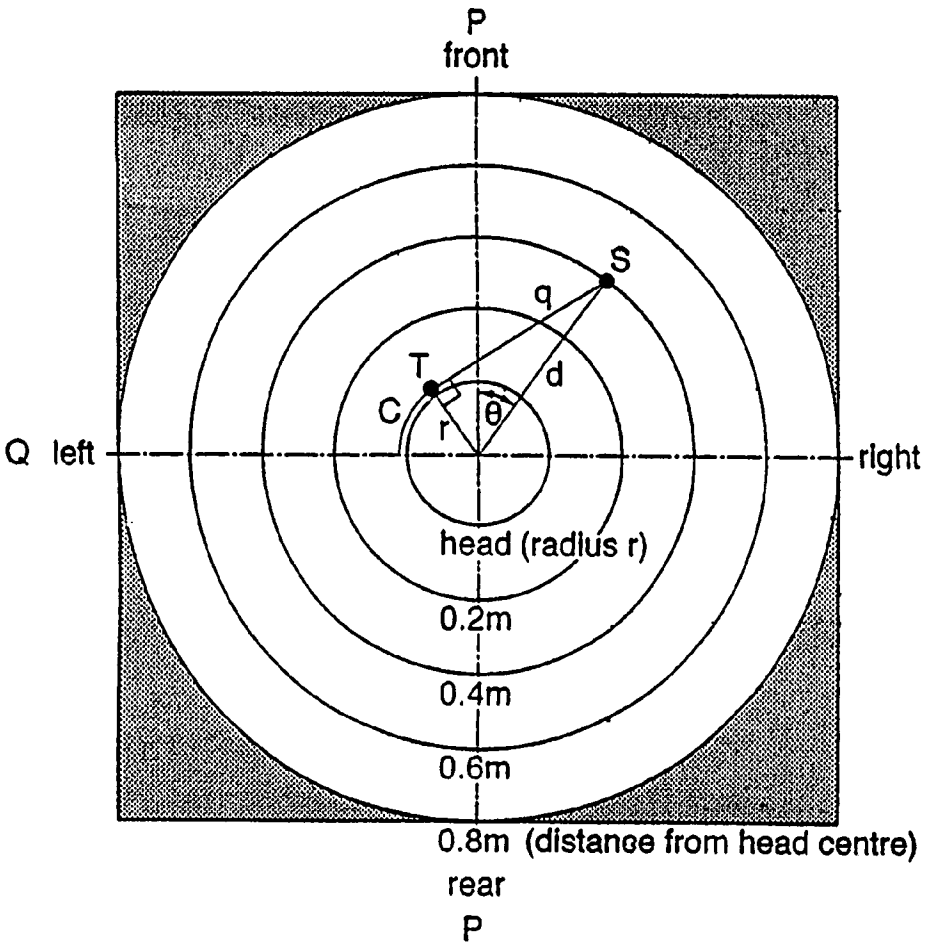
Figure 9:
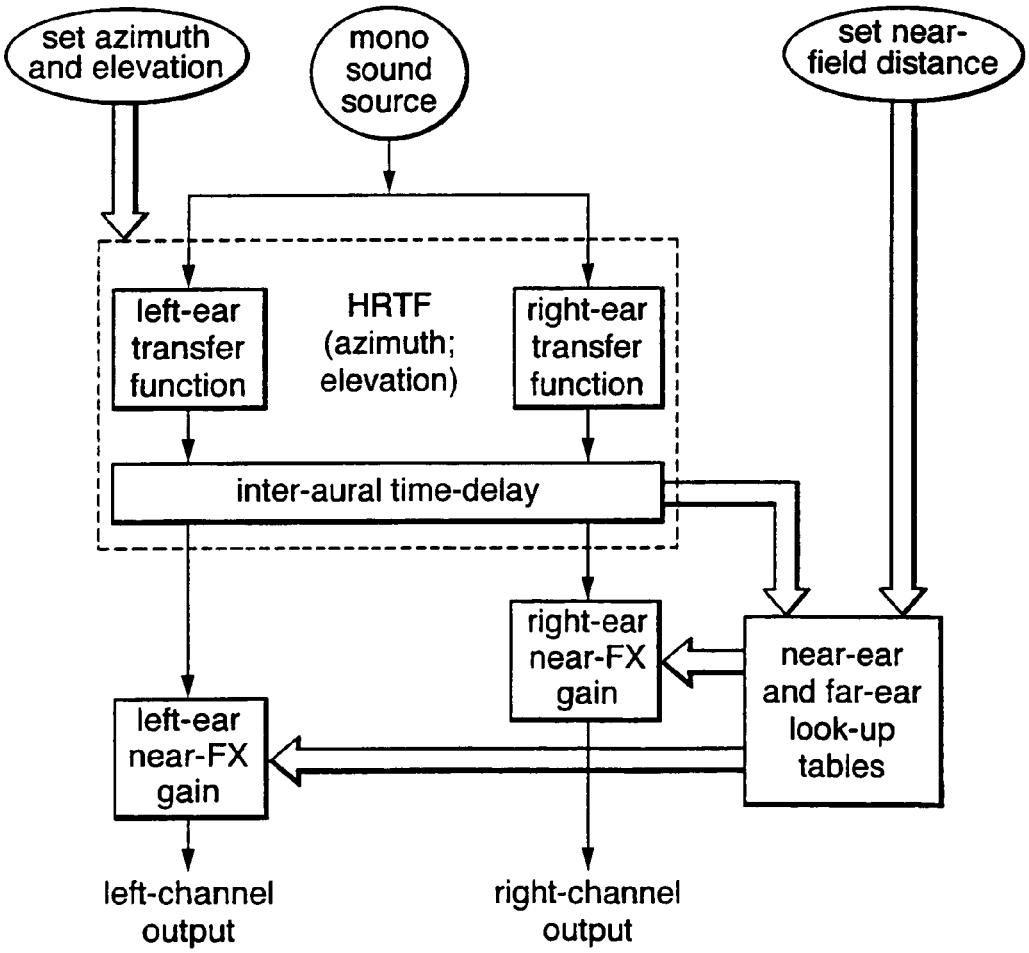
Figure 10:
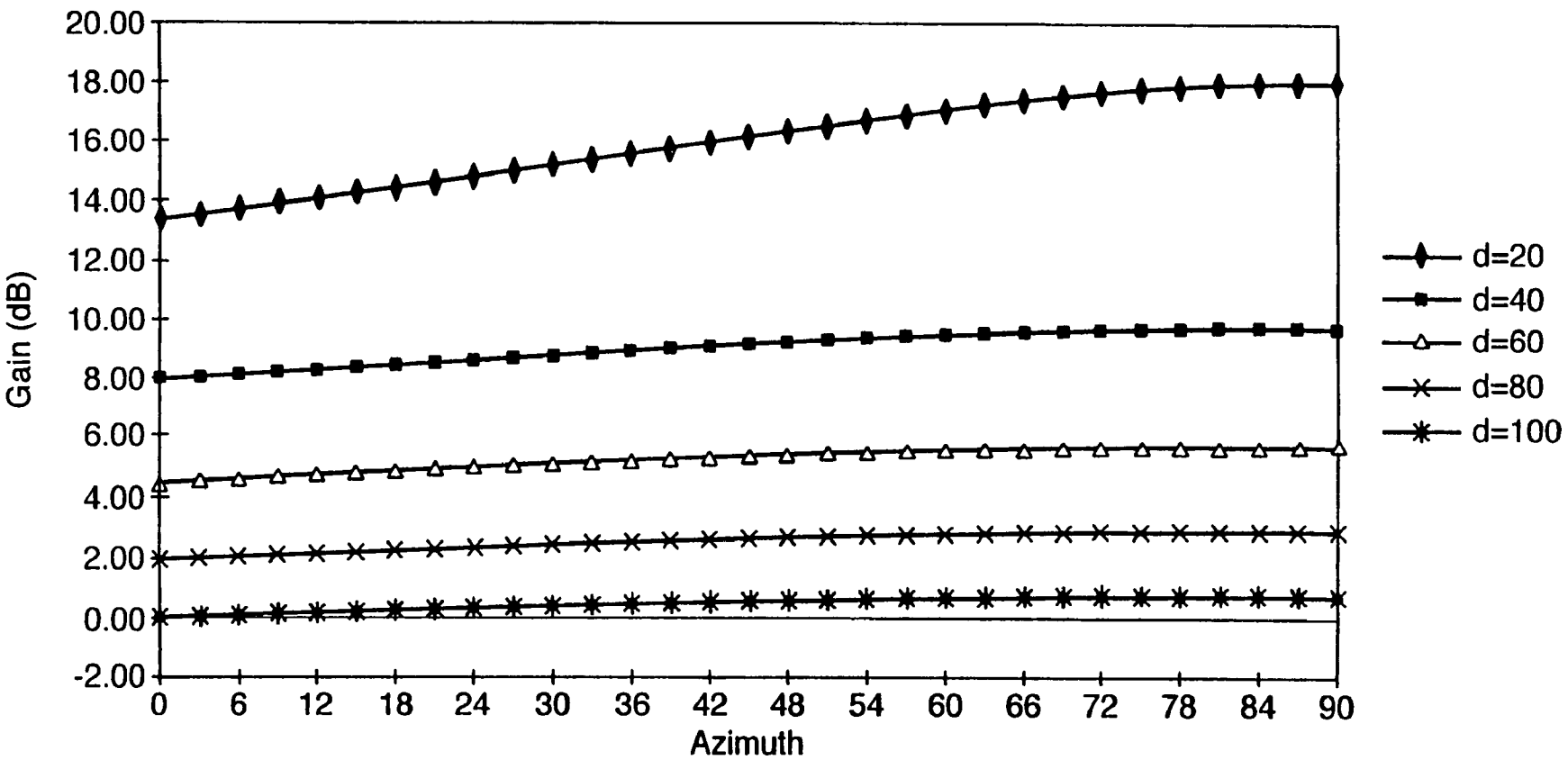
Figure 11:
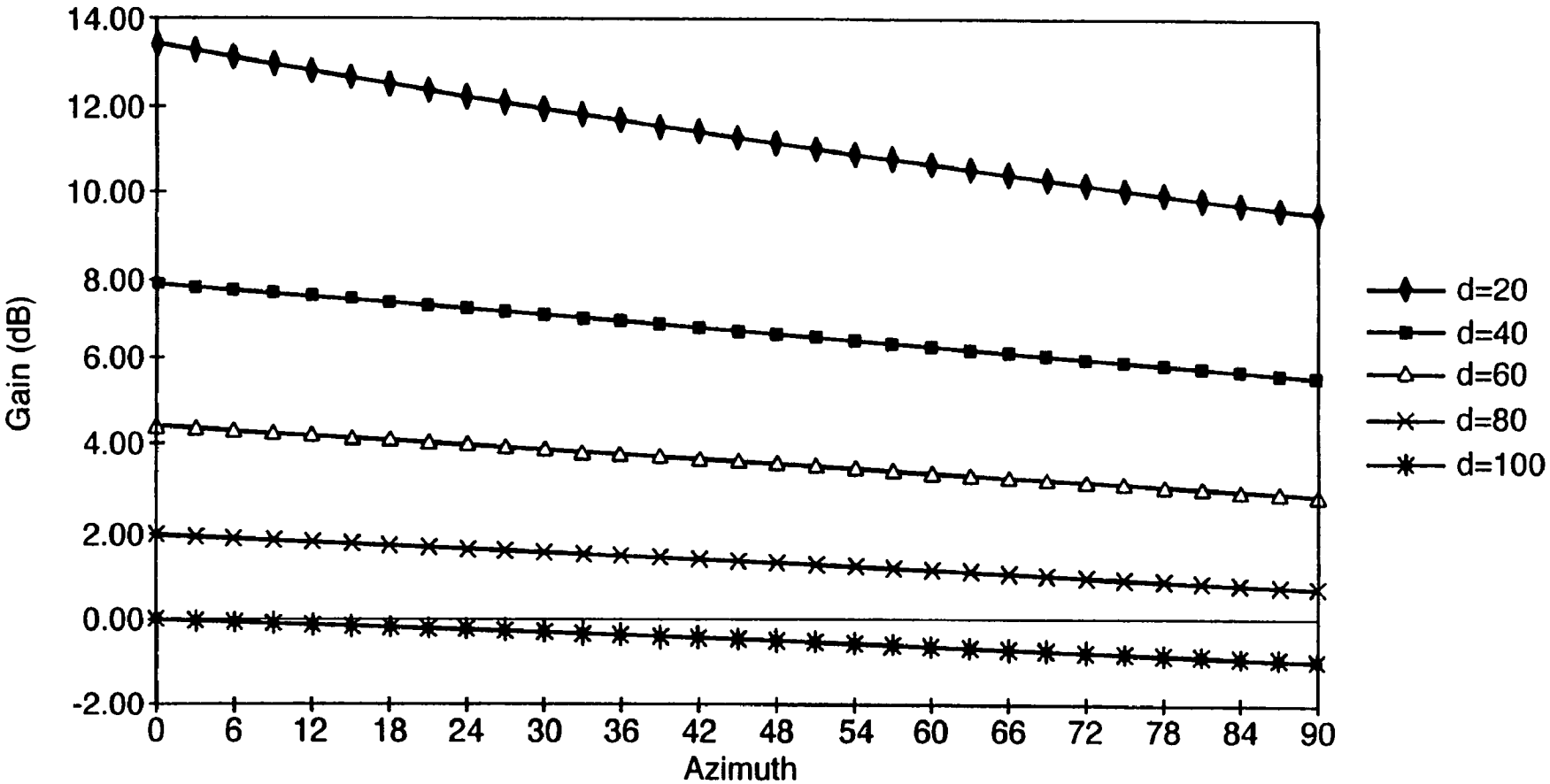

Embodiments of the invention will now be described, by way of example only, with reference to the accompanying diagrammatic drawings, in which FIG. 1 shows the head of a listener and a co-ordinate system, FIG. 2 shows a plan view of the head and an arriving sound wave, FIG. 3 shows the locus of points having an equal inter-aural or inter-aural time delay, FIG. 4 shows an isometric view of the locus of FIG. 3, FIG. 5 shows a plan view of the space surrounding a listener's head, FIG. 6A shows a further plan view of a listener's head showing paths for use in calculations of distance to the near ear, FIG. 6B shows a further plan view of a listener's head showing paths for use in calculations of distance to the near ear, FIG. 7A shows a further plan view of a listener's head showing paths for use in calculations of distance to the far ear, FIG. 7B shows a further plan view of a listener's head showing paths for use in calculations of distance to the far ear, FIG. 8 shows a block diagram of a prior art method, FIG. 9 shows a block diagram of a method according to the present invention, FIG. 10 shows a plot of near ear gain as a function of azimuth and distance, and FIG. 11 shows a plot of far ear gain as a function of azimuth and distance.

The present invention relates particularly to the reproduction of 3D-sound from two-speaker stereo systems or headphones. This type of 3D-sound is described, for example, in EP-B-0689756 which is incorporated herein by reference.

It is well known that a mono sound source can be digitally processed via a pair of "Head-Response Transfer Functions" (HRTFs), such that the resultant stereo-pair signal contains 3D-sound cues. These sound cues are introduced naturally by the head and ears when we listen to sounds in real life, and they include the inter-aural amplitude difference (IAD), inter-aural time difference (ITD) and spectral shaping by the outer ear. When this stereo signal pair is introduced efficiently into the appropriate ears of the listener, by headphones say, then he or she perceives the original sound to be at a position in space in accordance with the spatial location of the HRTF pair which was used for the signal-processing.

When one listens through loudspeakers instead of headphones, then the signals are not conveyed efficiently into the ears, for there is "transaural acoustic crosstalk" present which inhibits the 3D-sound cues. This means that the left ear hears a little of what the right ear is hearing (after a small, additional time-delay of around 0.2 ms), and vice versa. In order to prevent this happening, it is known to create appropriate "crosstalk cancellation" signals from the opposite loudspeaker. These signals are equal in magnitude and inverted (opposite in phase) with respect to the crosstalk signals, and designed to cancel them out. There are more advanced schemes which anticipate the secondary (and higher order) effects of the cancellation signals themselves contributing to secondary crosstalk, and the correction thereof, and these methods are known in the prior art.

When the HRTF processing and crosstalk cancellation are carried out correctly, and using high quality HRTF source data, then the effects can be quite remarkable. For example, it is possible to move the virtual image of a sound-source around the listener in a complete horizontal circle, beginning in front, moving around the right-hand side of the listener, behind the listener, and back around the left-hand side to the front again. It is also possible to make the sound source move in a vertical circle around the listener, and indeed make the sound appear to come from any selected position in space. However, some particular positions are more difficult to synthesise than others, some for psychoacoustic reasons, we believe, and some for practical reasons.

For example, the effectiveness of sound sources moving directly upwards and downwards is greater at the sides of the listener (azimuth=90°) than directly in front (azimuth=0°). This is probably because there is more left-right difference information for the brain to work with. Similarly, it is difficult to differentiate between a sound source directly in front of the listener (azimuth=0°) and a source directly behind the listener (azimuth=180°). This is because there is no time-domain information present for the brain to operate with (ITD=0), and the only other information available to the brain, spectral data, is similar in both of these positions. In practice, there is more HF energy perceived when the source is in front of the listener, because the high frequencies from frontal sources are reflected into the auditory canal from the rear wall of the concha, whereas from a rearward source, they cannot diffract around the pinna sufficiently to enter the auditory canal effectively.

In practice, it is known to make measurements from an artificial head in order to derive a library of HRTF data, such that 3D-sound effects can be synthesised. It is common practice to make these measurements at distances of 1 meter or thereabouts, for several reasons. Firstly, the sound source used for such measurements is, ideally, a point source, and usually a loudspeaker is used. However, there is a physical limit on the minimum size of loudspeaker diaphragms. Typically, a diameter of several inches is as small as is practical whilst retaining the power capability and low-distortion properties which are needed. Hence, in order to have the effects of these loudspeaker signals representative of a point source, the loudspeaker must be spaced at a distance of around 1 meter from the artificial head. Secondly, it is usually required to create sound effects for PC games and the like which possess apparent distances of several meters or greater, and so, because there is little difference between HRTFs measured at 1 meter and those measured at much greater distances, the 1 meter measurement is used.

The effect of a sound source appearing to be in the mid-distance (1 to 5 m, say) or far-distance (>5 m) can be created easily by the addition of a reverberation signal to the primary signal, thus simulating the effects of reflected sound waves from the floor and walls of the environment. A reduction of the high frequency (HF) components of the sound source can also help create the effect of a distant source, simulating the selective absorption of HF by air, although this is a more subtle effect. In summary, the effects of controlling the apparent distance of a sound source beyond several meters are known.

However, in many PC games situations, it is desirable to have a sound effect appear to be very close to the listener. For example, in an adventure game, it might be required for a "guide" to whisper instructions into one of the listener's ears, or alternatively, in a flight-simulator, it might be required to create the effect that the listener is a pilot, hearing air-traffic information via headphones. In a combat game, it might be required to make bullets appear to fly close by the listener's head. These effects are not possible with HRTFs measured at 1 meter distance.

It is therefore desirable to be able to create "near-field" distance effects, in which the sound source can appear to move from the loudspeaker distance, say, up close to the head of the listener, and even appear to "whisper" into one of the ears of the listener. In principle, it might be possible to make a full set of HRTF measurements at differing distances, say 1 meter, 0.9 meter, 0.8 meter and so on, and switch between these different libraries for near-field effects. However, as already noted above, the measurements are compromised by the loudspeaker diaphragm dimensions which depart from point-source properties at these distances. Also, an immense effort is required to make each set of HRTF measurements (typically, an HRTF library might contain over 1000 HRTF pairs which take several man weeks of effort to measure, and then a similar time is required to process these into useable filter coefficients), and so it would be very costly to do this. Also, it would require considerable additional memory space to store each additional HRTF library in the PC. A further problem would be that such an approach would result in quantised-distance effects: the sound source could not move smoothly to the listener's head, but would appear to "jump" when switching between the different HRTF sets.

Ideally, what is required is a means of creating near-field distance effects using a "standard" 1 meter HRTF set.

The present invention comprises a means of creating near-field distance effects for 3D-sound synthesis using a "standard" 1 meter HRTF set. The method uses an algorithm which controls the relative left-right channel amplitude difference as a function of (a) required proximity, and (b) spatial position. The algorithm is based on the observation that when a sound source moves towards the head from a distance of 1 meter, then the individual left and right-ear properties of the HRTF do not change a great deal in terms of their spectral properties. However, their amplitudes, and the amplitude difference between them, do change substantially, caused by a distance ratio effect. The small changes in spectral properties which do occur are related largely to head-shadowing effects, and these can be incorporated into the near-field effect algorithm in addition if desired.

In the present context, the expression "near-field" is defined to mean that volume of space around the listener's head up to a distance of about 1–1.5 meter from the centre of the head. For practical reasons, it is also useful to define a "closeness limit", and a distance of 0.2 m has been chosen for the present purpose of illustrating the invention. These limits have both been chosen purely for descriptive purposes, based respectively upon a typical HRTF measurement distance (1 m) and the closest simulation distance one might wish to create, in a game, say. However, it is also important to note that the ultimate "closeness" is represented by the listener hearing the sound ONLY in a single ear, as would be the case if he or she were wearing a single earphone. This, too, can be simulated, and can be regarded as the ultimately limiting case for close to head or "near-field" effects. This "whispering in one ear effect" can be achieved simply by setting the far ear gain to zero, or to a sufficiently low value to be inaudible. Then, when the processed audio signal is is auditioned on headphones, or via speakers after appropriate transaural crosstalk cancellation processing, the sounds appear to be "in the ear".

First, consider for example the amplitude changes. When the sound source moves towards the head from 1 meter distance, the distance ratio (left-ear to sound source vs. right-ear to sound source) becomes greater. For example, for a sound source at 45° azimuth in the horizontal plane, at a distance of 1 meter from the centre of the head, the near ear is about 0.9 meter distance and the far-ear around 1.1 meter. So the ratio is (1.1/0.9)=1.22. When the sound source moves to a distance of 0.5 meter, then the ratio becomes (0.6/0.4) =1.5, and when the distance is 20 cm, then the ratio is approximately (0.4/0.1)=4. The intensity of a sound source diminishes with distance as the energy of the propagating wave is spread over an increasing area. The wavefront is similar to an expanding bubble, and the energy density is related to the surface area of the propagating wavefront, which is related by a square law to the distance travelled (the radius of the bubble).

This gives the well known inverse square law reducion in intensity with distance travelled for a point source. The intensity ratios of left and right channels are related to the inverse ratio of the squares of the distances. Hence, the intensity ratios for distances of 1 m, 0.5 m and 0.2 m are approximately 1.49, 2.25 and 16 respectively. In dB units, these ratios are 1.73 dB, 3.52 dB and 12.04 dB respectively.

Next, consider the head-shadowing effects. When a sound source is 1 meter from the head, at azimuth 45°, say, then the incoming sound waves only have one-quarter of the head to travel around in order to reach the furthermost ear, lying in the shadow of the head. However, when the sound source is much closer, say 20 cm, than the waves have an entire hemisphere to circumnavigate before they can reach the furthermost ear. Consequently, the HP components reaching the furthermost ear are proportionately reduced.

It is important to note, however, that the situation is more complicated than described in the above example, because the intensity ratio differences are position dependent. For example, if the aforementioned situation were repeated for a frontal sound source (azimuth 0°) approaching the head, then there would be no difference between the left and right channel intensities, because of symmetry. In this instance, the intensity level would simply increase according to the inverse square law.

How then might it be possible to link any particular, close, position in three dimensional space with an algorithm to control the L and R channel gains correctly and accurately? The key factor is the inter-aural time delay, for this can be used to index the algorithm to spatial position in a very effective and efficient manner.

The invention is best described in several stages, beginning with an account of the inter-aural time-delay and followed by derivations of approximate near-ear and far-ear distances in the listener's near-field. FIG. 1 shows a diagram of the near-field space around the listener, together with the reference planes and axes which will be referred to during the following descriptions, in which P-P' represents the front-back axis in the horizontal plane, intercepting the centre of the listener's head, and with Q-Q' representing the corresponding lateral axis from left to right As has already been noted, there is a time-of-arrival difference between the left and right ears when a sound wave is incident upon the head, unless the sound source is in the median plane, which includes the pole positions (i.e. directly in front, behind above and below). This is known as the inter-aural time delay (ITD), and can be seen depicted in diagram form in FIG. 2, which shows a plan view of a conceptual head, with left ear and right ear receiving a sound signal from a distant source at azimuth angle θ (about +45° as shown here). When the wavefront (W-W') arrives at the right ear, then it can be seen that there is a path length of (a+b) still to travel before it arrives at the left ear (LE). By the symmetry of the configuration, the b section is equal to the distance from the head centre to wavefront W-W', and hence: b=r.sin θ. It will be clear that the arc a represents a proportion of the circumference, subtended by θ. By inspection, then, the path length (a+b) is given by:

$$\text{path length} = \left(\frac{\theta}{360}\right)2\pi r + r.\sin\theta \tag{1}$$

(This path length (in cm units) can be converted into the corresponding time-delay value (in ms) by dividing by 34.3.)

It can be seen that, in the extreme, when θ tends to zero, so does the path length. Also, when θ tends to 90°, and the head diameter is 15 cm, then the path length is about 19.3 cm, and the associated ITD is about 563 μs. In practice, the ITDs are measured to be slightly larger than this, typically up to 702 μs. It is likely that this is caused by the non-spherical nature of the head (including the presence of the pinnae and nose), the complex diffractive situation and surface effects.

At this stage, it is important to appreciate that, although this derivation relates only to the front-right quadrant in the horizontal plane (angles of azimuth between 0° and 90°), it is valid in all four quadrants. This is because (a) the front-right and right-rear quadrants are symmetrical about the Q-Q' axis, and (b) the right two quadrants are symmetrical with the left two quadrants. (Naturally, in this latter case, the time-delays are reversed, with the left-ear signal leading the right-ear signal, rather than lagging it).

Consequently, it will be appreciated that there are two complementary positions in the horizontal plane associated with any particular (valid) time delay, for example 30° &150°; 40° &140°, and so on. In practice, measurements show that the time-delays are not truly symmetrical, and indicate, for example, that the maximum time delay occurs not at 90° azimuth, but at around 85°. These small asymmetries will be set aside for the moment, for clarity of description, but it will be seen that use of the time-delay as an index for the algorithm takes into account all of the detailed non-symmetries, thus providing a faithful means of simulating close sound sources.

Following on from this, if one considers the head as an approximately spherical object, one can see that the symmetry extends into the third dimension, where the upper hemisphere is symmetrical to the lower one, mirrored around the horizontal plane. Accordingly, it can be appreciated that, for a given (valid) inter-aural time-delay, there exists not just a pair of points on the horizontal (h-) plane, but a locus, approximately circular, which intersects the h-plane at the aforementioned points. In fact, the locus can be depicted as the surface of an imaginary cone, extending from the appropriate listener's ear, aligned with the lateral axis Q-Q' (FIGS. 3 and 4).

At this stage, it is important to note that:

(1) the inter-aural time-delay represents a very dose approximation of the relative acoustic path length difference between a sound source and each of the ears; and (2) the inter-aural time-delay is an integral feature of every HRTF pair.

Consequently, when any 3D-sound synthesis system is using HRTF data, the associated inter-aural time delay can be used as an excellent index of relative path length difference. Because it is based on physical measurements, it is therefore a true measure, incorporating the various real-life non-linearities described above.

The next stage is to find out a means of determining the value of the signal gains which must be applied to the left and right-ear channels when a "close" virtual sound source is required. This can be done if the near- and far-ear situations are considered in turn, and if we use the 1 meter distance as the outermost reference datum, at which point we define the sound intensity to be 0 dB.

FIG. 5 shows a plan view of the listener's head, together with the near-field surrounding it. In the first instance, we are particularly interested in the front-right quadrant. If we can define a relationship between the near-field spatial position in the h-plane and distance to the near-ear (right ear in this case), then this can be used to control the right-channel gain. The situation is trivial to resolve, as shown in FIG. 6B, if the "true" source-to-ear paths for the close frontal positions (such as path "A") are assumed to be similar to the direct distance (indicated by "B"). This simplifies the situation, as is shown on the diagram of FIG. 6A, indicating a sound source S in the right front quadrant, at an azimuth angle of with respect to the listener. Also shown is the distance d, of the sound source from the head centre, and the distance, p, for the sound source from the near-ear. The angle sub-tended by S-head-Q' is (900−). The near ear distance can be derived using the cosine rule, from the triangle S-head_center-near_ear:

$$p^2=d^2+r^2-2dr.\cos(90-\theta)|_{\theta=0}^{\theta=90} \tag{2}$$

If we assume the head radius, r, is 7.5 cm, then p is given by:

$$p=\sqrt{d^2+(7.5)^2-15d.\sin\theta}|_{\theta=0}^{\theta=90} \tag{3}$$

FIGS. 7A and 7B show plan views of the listener's head, together with the near field area surrounding it. Once again, we are particularly interested in the front-right quadrant. However, the path between the sound source and the far-ear comprises two serial elements, as is shown clearly in the detail of FIG. 7B. First there is a direct path from the source, S, tangential to the head, labeled g, and second, there is sa circumferential path around the head, C, from the tangent point, T, to the far ear. As before, the distance from the sound source to the centre of the head is d, and the head radius is r. The angle subtended by the tangent point and the head centre at the source is angle R.

The tangential path, q, can be calculated simply from the triangle:

$$q=\sqrt{(d^2-r^2)} \tag{4}$$

and also the angle R:

$$R=\sin^{-1}\left(\frac{r}{d}\right) \tag{5}$$

Considering the triangle S-T-head_centre, the angle P-head_centre-T is (90-θ-R), and so the angle T-head_centre-Q (the angle subtended by the arc itself) must be (θ+R). The circumferential path can be calculated from this angle, and is:

$$C=\left\{\frac{\theta+R}{360}\right\}2\pi r \tag{6}$$

Hence, by substituting (5) into (6), and combining with (4), an expression for the total distance (in cm) from sound source to far-ear for a 7.5 cm radius head can be calculated:

$$\text{Far}-\text{Ear Total Path}=\sqrt{(d^2-7.5^2)}+2\pi r\left\{\frac{\theta+\sin^{-1}\left(\frac{75}{d}\right)}{360}\right\} \tag{7}$$

It is instructive to compute the near-ear gain factor as a function of azimuth angle at several distances from the listener's head. This has been done, and is depicted graphically in FIG. 10. The gain is expressed in dB units with respect to the 1 meter distance reference, defined to be 0 dB. The gain, in dB, is calculated according to the inverse square law from path length, d (in cm), as:

$$\text{gain (dB)}=10\log\left(\frac{10^4}{d^2}\right) \tag{8}$$

As can be seen from the graph, the 100 cm line is equal to 0 dB at azimuth 0°, as one expects, and as the sound source moves around to the 90° position, in line with the near-ear, the level increases to +0.68 dB, because the source is actually slightly closer. The 20 cm distance line shows a gain of 13.4 dB at azimuth 0°, because, naturally, it is closer, and, again, the level increases as the sound source moves around to the 90° position, to 18.1: a much greater increase this time. The other distance lines show intermediate properties between these two extremes.

Next, consider the near-ear gain factor. This is depicted graphically in FIG. 11. As can be seen from the graph, the 100 cm line is equal to 0 dB at azimuth 0° (as one expects), but here, as the sound source moves around to the 90 position, away from the far-ear, the level decreases to −0.99 dB. The 20 cm distance line shows a gain of 13.8 dB at azimuth 0°, similar to the equidistant near-ear, and, again, the level decreases as the sound source moves around to the 90 position, to 9.58: a much greater decrease than for the 100 cm data. Again, the other distance lines show intermediate properties between these two extremes.

It has been shown that a set of HRTF gain factors suitable for creating near-field effects for virtual sound sources can be calculated, based on the specified azimuth angle and required distance. However, in practice, the positional data is usually specified in spherical co-ordinates, namely: an angle of azimuth, θ, and an angle of elevation, ϕ (and now, according to the invention, distance, d). Accordingly, it is required to compute and transform this data into an equivalent h-plane azimuth angle (and in the range 0° to 90°) in order to compute the appropriate L and R gain factors, using equations (3) and (7). This can require significant computational resource, and, bearing in mind that the CPU or dedicated DSP will be running at near-full capacity, is best avoided if possible.

An alternative approach would be to create a universal "look-up" table, featuring L and R gain factors for all possible angles of azimuth and elevation (typically around 1,111 in an HRTF library), at several specified distances. Hence this table, for four specified distances, would require 1,111×4×2 elements (8,888), and therefore would require a significant amount of computer memory allocated to it.

The inventors have, however, realised that the time-delay carried in each HRTF can be used as an index for selecting the appropriate L and R gain factors. Every inter-aural time-delay is associated with a horizontal plane equivalent, which, in turn, is associated with a specific azimuth angle. This means that a much smaller look-up table can be used. An HRTF library of the above resolution features horizontal plane increments of 3°, such that there are 31 HRTFs in the range 0° to 90°. Consequently, the size of a time-delay-indexed look-up table would be 31×4×2 elements (248 elements), which is only 2.8% the size of the "universal" table, above.

The final stage in the description of the invention is to tabulate measured, horizontal-plane, HRTF time-delays in the range 0° to 90° against their azimuth angles, together with the near-ear and far-ear gain factors derived in previous sections. This links the time-delays to the gain factors, and represents the look-up table for use in a practical system. This data is shown below in the form of Table 1 (near-ear data) and Table 2 (far-ear data).

TABLE 1

Time-delay based look-up table for determining near-ear gain factor as function of distance between virtual sound source and centre of the head.

| Time-Delay (samples) | Azimuth (degrees) | d = 20 (cm) | d = 40 (cm) | d = 60 (cm) | d = 80 (cm) | d = 100 (cm) |
|---|---|---|---|---|---|---|
| 0 | 0 | 13.41 | 7.81 | 4.37 | 1.90 | −0.02 |
| 1 | 3 | 13.56 | 7.89 | 4.43 | 1.94 | 0.01 |
| 2 | 6 | 13.72 | 7.98 | 4.48 | 1.99 | 0.04 |
| 4 | 9 | 13.88 | 8.06 | 4.54 | 2.03 | 0.08 |
| 5 | 12 | 14.05 | 8.15 | 4.60 | 2.07 | 0.11 |
| 6 | 15 | 14.22 | 8.24 | 4.66 | 2.11 | 0.15 |
| 7 | 18 | 14.39 | 8.32 | 4.71 | 2.16 | 0.18 |
| 8 | 21 | 14.57 | 8.41 | 4.77 | 2.20 | 0.21 |
| 9 | 24 | 14.76 | 8.50 | 4.83 | 2.24 | 0.25 |
| 10 | 27 | 14.95 | 8.59 | 4.88 | 2.28 | 0.28 |
| 11 | 30 | 15.14 | 8.68 | 4.94 | 2.32 | 0.31 |
| 12 | 33 | 15.33 | 8.76 | 4.99 | 2.36 | 0.34 |
| 13 | 36 | 15.53 | 8.85 | 5.05 | 2.40 | 0.37 |
| 14 | 39 | 15.73 | 8.93 | 5.10 | 2.44 | 0.40 |
| 15 | 42 | 15.93 | 9.01 | 5.15 | 2.48 | 0.43 |
| 16 | 45 | 16.12 | 9.09 | 5.20 | 2.51 | 0.46 |
| 18 | 48 | 16.32 | 9.17 | 5.25 | 2.55 | 0.49 |
| 19 | 51 | 16.51 | 9.24 | 5.29 | 2.58 | 0.51 |
| 20 | 54 | 16.71 | 9.32 | 5.33 | 2.61 | 0.53 |
| 21 | 57 | 16.89 | 9.38 | 5.37 | 2.64 | 0.56 |
| 23 | 60 | 17.07 | 9.44 | 5.41 | 2.66 | 0.58 |
| 24 | 63 | 17.24 | 9.50 | 5.44 | 2.69 | 0.59 |
| 25 | 66 | 17.39 | 9.55 | 5.48 | 2.71 | 0.61 |
| 26 | 69 | 17.54 | 9.60 | 5.50 | 2.73 | 0.63 |
| 27 | 72 | 17.67 | 9.64 | 5.53 | 2.74 | 0.64 |
| 27 | 75 | 17.79 | 9.68 | 5.55 | 2.76 | 0.65 |
| 28 | 78 | 17.88 | 9.71 | 5.57 | 2.77 | 0.66 |
| 28 | 81 | 17.96 | 9.73 | 5.58 | 2.78 | 0.67 |
| 29 | 84 | 18.02 | 9.75 | 5.59 | 2.79 | 0.67 |
| 29 | 87 | 18.05 | 9.76 | 5.59 | 2.79 | 0.68 |
| 29 | 90 | 18.06 | 9.76 | 5.60 | 2.79 | 0.68 |

TABLE 2

Time-delay based look-up table for determining far-ear gain factor as function of distance between virtual sound source and centre of the head.

| Time-Delay (samples) | Azimuth (degrees) | d = 20 (cm) | d = 40 (cm) | d = 60 (cm) | d = 80 (cm) | d = 100 (cm) |
|---|---|---|---|---|---|---|
| 0 | 0 | 13.38 | 7.81 | 4.37 | 1.90 | −0.02 |
| 1 | 3 | 13.22 | 7.72 | 4.31 | 1.86 | −0.06 |
| 2 | 6 | 13.07 | 7.64 | 4.26 | 1.82 | −0.09 |
| 4 | 9 | 12.92 | 7.56 | 4.20 | 1.77 | −0.13 |
| 5 | 12 | 12.77 | 7.48 | 4.15 | 1.73 | −0.16 |
| 6 | 15 | 12.62 | 7.40 | 4.09 | 1.69 | −0.19 |
| 7 | 18 | 12.48 | 7.32 | 4.04 | 1.65 | −0.23 |
| 8 | 21 | 12.33 | 7.24 | 3.98 | 1.61 | −0.26 |
| 9 | 24 | 12.19 | 7.16 | 3.93 | 1.57 | −0.29 |
| 10 | 27 | 12.06 | 7.08 | 3.88 | 1.53 | −0.33 |
| 11 | 30 | 11.92 | 7.01 | 3.82 | 1.49 | −0.36 |
| 12 | 33 | 11.79 | 6.93 | 3.77 | 1.45 | −0.39 |
| 13 | 36 | 11.66 | 6.86 | 3.72 | 1.41 | −0.42 |
| 14 | 39 | 11.53 | 6.78 | 3.67 | 1.37 | −0.46 |
| 15 | 42 | 11.40 | 6.71 | 3.61 | 1.33 | −0.49 |
| 16 | 45 | 11.27 | 6.63 | 3.56 | 1.29 | −0.52 |
| 18 | 48 | 11.15 | 6.56 | 3.51 | 1.25 | −0.55 |
| 19 | 51 | 11.03 | 6.49 | 3.46 | 1.21 | −0.58 |
| 20 | 54 | 10.91 | 6.42 | 3.41 | 1.17 | −0.62 |
| 21 | 57 | 10.79 | 6.35 | 3.36 | 1.13 | −0.65 |
| 23 | 60 | 10.67 | 6.27 | 3.31 | 1.09 | −0.68 |
| 24 | 63 | 10.55 | 6.20 | 3.26 | 1.05 | −0.71 |
| 25 | 66 | 10.44 | 6.14 | 3.21 | 1.01 | −0.74 |

TABLE 2-continued

Time-delay based look-up table for determining far-ear gain factor as function of distance between virtual sound source and centre of the head.

| Time-Delay (samples) | Azimuth (degrees) | d = 20 (cm) | d = 40 (cm) | d = 60 (cm) | d = 80 (cm) | d = 100 (cm) |
|---|---|---|---|---|---|---|
| 26 | 69 | 10.33 | 6.07 | 3.16 | 0.97 | −0.77 |
| 27 | 72 | 10.22 | 6.00 | 3.11 | 0.94 | −0.80 |
| 27 | 75 | 10.11 | 5.93 | 3.06 | 0.90 | −0.84 |
| 28 | 78 | 10.00 | 5.86 | 3.01 | 0.86 | −0.87 |
| 28 | 81 | 9.89 | 5.80 | 2.97 | 0.82 | −0.90 |
| 29 | 84 | 9.78 | 5.73 | 2.92 | 0.79 | −0.93 |
| 29 | 87 | 9.68 | 5.66 | 2.87 | 0.75 | −0.96 |
| 29 | 90 | 9.58 | 5.60 | 2.82 | 0.71 | −0.99 |

Note that the time-delays in the above tables are shown in units of sample periods related to a 44.1 kHz sampling rate, hence each sample unit is 22.676 μs.

Consider, by way of example, the case when a virtual sound source is required to be positioned in the horizontal plane at an azimuth of 60°, and at a distance of 0.4 meters. Using Table 1, the near-ear gain which must be applied to the HRTF is shown as 9.44 dB. and the far-ear gain (from Table 2) is 6.27 dB.

Consider, as a second example, the case when a virtual sound source is required to be positioned out of the horizontal plane, at an azimuth of 42° and elevation of −60°, at a distance of 0.2 meters. The HRTF for this particular spatial position has a time-delay of 7 sample periods (at 44.1 kHz). Consequently, using Table 1, the near-ear gain which must be applied to the HRTF is shown as 14.39 dB, and the far-ear gain (from Table 2) is 12.48 dB. (This HRTF time-delay is the same as that of a horizontal-plane HRTF with an azimuth value of 18°).

The implementation of the invention is straightforward, and is depicted schematically in FIG. 9. FIG. 8 shows the conventional means of creating a virtual sound source, as follows. First, the spatial position of the virtual sound source is specified, and used to select an HRTF appropriate to that position. The HRTF comprises a left-ear function, a right-ear function and an inter-aural time-delay value. In a computer system for creating the virtual sound source, the HRTF data will generally be in the form of FIR filter coefficients suitable for controlling a pair of FIR filters (one for each channel), and the time-delay will be represented by a number. A monophonic sound source is then transmitted into the signal-processing scheme, as shown, thus creating both a left- and right-hand channel outputs. (These output signals are then suitable for onward transmission to the listener's headphones, or crosstalk-cancellation processing for loudspeaker reproduction, or other means).

The invention, shown in FIG. 9, supplements this procedure, but requires little extra computation. This time, the signals are processed as previously, but a near-field distance is also specified, and, together with the time-delay data from the selected HRTF, is used to select the gain for respective left and right channels from a look-up table; this data is then used to control the gain of the signals before they are output to subsequent stages, as described before.

The left channel output and the right channel output shown in FIG. 9 can be combined directly with a normal stereo or binaural signal being fed to headphones, for example, simply by adding the signal in corresponding channels. If the outputs shown in FIG. 9 are to be combined with those created for producing a 3D sound-field generated, for example, by binaural synthesis (such as, for example, using the Sensaura (Trade Mark) method described in EP-B-0689756), then the two output signals should be added to the corresponding channels of the binaural signal after transaural crosstalk compensation has been performed.

Although in the example described above the setting of magnitude of the left and right signals is performed after modification using a head response transfer function, the magnitudes may be set before such signal processing if desired, so that the order of the steps in the described method is not an essential part of the invention.

Although in the example described above the position of the virtual sound source relative to the preferred position of a listener's head in use is constant and does not change with time, by suitable choice of sucessive different positions for the virtual sound source it can be made to move relative to the head of the listener in use if desired. This apparent movement may be provided by changing the direction of the virtual souce from the preferred position, by changing the distance to it, or by changing both together.

Finally, the content of the accompanying abstract is hereby incorporated into this description by reference.

The invention claimed is:

1. A method of providing localization cues to a source audio signal to perceive a sound source at a selected direction and a selected near field distance less than or equal to about 1.5 m from a listener's head based on a head related transfer function (HRTF) pair determined for the sound source located at the selected direction and a reference distance at a larger distance from the listener's head than the selected near field distance, the method comprising:

providing a two channel audio signal from the source audio signal;

spectrally shaping the two channel audio signal based on the HRTF pair;

introducing a time delay between the channels of the two channel audio signal based on an interaural time delay associated with the selected direction; and applying a different gain factor to each of the two channels, wherein the different gain factors are determined based on the selected direction and the selected near field distance from the listener's head.

2. The method as claimed in claim 1 wherein the different gain factors are determined for each ear based on the inverse square of the respective sound source to ear distances for the sound source positioned at the selected near field distance from the listener's head.

3. The method as claimed in claim 1 wherein the different gain factors are determined by providing a lookup table of gain values indexed by the interaural time delay associated with the selected direction and selecting the respective gain values from the lookup table.

4. The method as recited in claim 1 wherein the different gain factors are determined by selecting the interaural time delay associated with the selected direction as representing the difference in path lengths between the sound source and the respective ears, determining a horizontal plane azimuth from the interaural time delay, and determining the respective sound source to ear distances for the sound source positioned at the near field distance.

5. The method as recited in claim 1 wherein the reference distance is about 1.0 m.

6. The method as recited in claim 1 wherein the near field distance is greater than or equal to 0.2 m and less than or equal to about 1.5 m.

7. The method as recited in claim 1 wherein applying a different gain factor occurs before the spectral shaping of the left and right channel signals.

8. The method as recited in claim 1 wherein applying a different gain factor occurs after the spectral shaping of the left and right channel signals.

9. The method as recited in claim 1 further comprising modifying the frequency response of one of the two channels to reflect head shadowing effects at the near field distance.

10. The method as recited in claim 1 wherein the HRTF pair is selected from a plurality of HRTF pairs respectively corresponding to a plurality of directions at the reference distance.

11. The method as recited in claim 1 wherein the source audio signal having been provided with localization cues is combined with a further two or more channel audio signal.

12. The method as recited in claim 1 wherein introducing a time delay between the channels of the two channel audio signal occurs before applying a different gain factor to each of the two channels.

13. A computer readable storage medium having stored thereon a computer program for implementing a method of providing localization cues to a source audio signal to perceive a sound source at a selected direction and a selected near field distance less than or equal to about 1.5 m from a listener's head based on a head related transfer function (HRTF) pair determined for the sound source located at the selected direction and a reference distance at a larger distance from the listener's head than the selected near field distance, said computer program comprising a set of instructions for:

providing a two channel audio signal from the source audio signal;

spectrally shaping the two channel audio signal based on the HRTF pair;

introducing a time delay between the channels of the two channel audio signal based on an interaural time delay associated with the selected direction; and applying a different gain factor to each of the two channels, wherein the different gain factors are determined based on the selected direction and the selected near field distance from the listener's head.

14. The computer readable medium as recited in claim 13 wherein the different gain factors are determined for each ear based on the inverse square of the respective sound source to ear distances for the sound source positioned at the selected near field distance from the listener's head.

15. The computer readable medium as recited in claim 13 wherein the different gain factors are determined by providing a lookup table of gain values indexed by the interaural time delay associated with the selected direction and selecting the respective gain values from the lookup table.

16. The computer readable medium as recited in claim 13 wherein the reference distance is about 1.0 m.

17. The computer readable medium as recited in claim 13 wherein the near field distance is greater than or equal to 0.2 m and less than or equal to about 1.5 m.

18. The computer readable medium as recited in claim 13 wherein applying a different gain factor occurs before the spectral shaping of the left and right channel signals.

19. The computer readable medium as recited in claim 13 wherein applying a different gain factor occurs after the spectral shaping of the left and right channel signals.

20. The computer readable medium as recited in claim 13 wherein the instructions further comprise modifying the frequency response of one of the two channels to reflect head shadowing effects at the near field distance.

21. The computer readable medium as recited in claim 13 wherein the HRTF pair is selected from a plurality of HRTF pairs respectively corresponding to a plurality of directions at the reference distance.

22. An apparatus for processing a source audio signal to perceive a sound source at a selected direction and a selected near field distance less than or equal to about 1.5 m from a listener's head, comprising:

a memory for storing a plurality of HRTF pairs corresponding to a plurality of different directions from a sound source to the listener at a reference distance from the listener's head, said reference distance being larger than the near field distance; and a processor configured to perform the following method:

providing a two channel audio signal from the source audio signal;

selecting one of the plurality of HRTF pairs to correspond to the selected direction;

spectrally shaping the two channel audio signal based on the selected HRTF pair;

introducing a time delay between the channels of the two channel audio signal based on an interaural time delay associated with the selected direction; and applying a different gain factor to each of the two channels, wherein the different gain factors are determined based on the selected direction and the selected near field distance from the listener's head.

23. The apparatus as recited in claim 22 wherein the different gain factors are determined for each ear based on the inverse square of the respective sound source to ear distances for the sound source positioned at the selected near field distance from the listener's head.

24. The apparatus as recited in claim 22 wherein the different gain factors are determined by providing a lookup table of gain values indexed by the interaural time delay associated with the selected direction and selecting the respective gain values from the lookup table.

25. The apparatus as recited in claim 22 wherein the different gain factors are determined by selecting the interaural time delay associated with the selected direction as representing the difference in path lengths between the sound source and the respective ears, determining a horizontal plane azimuth from the interaural time delay, and determining the respective sound source to ear distances for the sound source positioned at the near field distance.

26. The apparatus as recited in claim 22 wherein the reference distance is about 1.0 m and the near field distance is greater than or equal to 0.2 m and less than or equal to about 1.0 m.

27. The apparatus as recited in claim 22 wherein applying a different gain factor occurs before the spectral shaping of the left and right channel signals.

28. The apparatus as recited in claim 22 wherein applying a different gain factor occurs after the spectral shaping of the left and right channel signals.

29. The apparatus as recited in claim 22 wherein introducing a time delay between the channels of the two channel audio signal occurs before applying a different gain factor to each of the two channels.

30. A method for generating a two channel audio signal, having:

a right signal for a right ear of a listener and a left signal for a left ear of said listener, comprising:

spectrally shaping a two channel input signal derived from a source audio signal, the spectral shaping based on at least a selected one of a plurality of head related transfer functions (HRTF's) determined for a sound source at a reference distance and a selected direction from the listener's head;

applying a different gain adjustment to each of the channels of the two channel signal, the gain adjustment comprising selecting respective values for magnitude of said left signal and magnitude of said right signal to provide cues for perception of a near field sound source at a near field distance less than or equal to about 1.5 m from the listener's head, said near field distance being less than the reference distance, each of the respective magnitudes based on the distance from the near field sound near field source to the respective one of the left and right ears of the listener; and introducing a time delay between each of the channels of the two channel audio signal based on an interaural time delay associated with the selected direction.

31. The method recited in claim 30 wherein the different gain adjustments are determined by providing a lookup table of gain values indexed by the interaural time delay associated with the selected direction and selecting the respective gain values from the lookup table.

32. The method recited in claim 30 wherein the different gain adjustments are determined by selecting the interaural time delay associated with the selected direction as representing the difference in path lengths between the near field sound source and the respective ears, determining a horizontal plane azimuth from the interaural time delay, and determining the respective near field sound source to near distances for the sound source positioned at the near field distance.

33. A method of providing localization cues to a source audio signal to perceive a sound source at a selected direction and a selected near field distance from a listener's head based on a head related transfer function (HRTF) pair selected from a library containing a plurality of HRTF pairs determined for the near field sound source located at a larger 1.0 m reference distance from the listener's head, the method comprising:

converting the source audio signal into a two channel audio signal, each of the channels having the identical source audio signal content;

introducing a time delay between the channels of the two channel audio signal based on an interaural time delay associated with the selected direction;

spectrally shaping the two channel audio signal based on the selected HRTF pair; and applying a different gain factor to each of the two channels, wherein the different gain factors are determined based on the selected direction and the selected near field distance less than 1.0 m from the listener's head, the different gain factors being applied to result in the intensity ratios between the respective channels being proportional to the inverse squares of the distances between the corresponding ears and the sound source when located at a near filed distance form the listener's head.

34. The method as recited in claim 33 wherein the different gain factors are determined by one of calculation or derived form a lookup table indexed by the interaural time delay value.

* * * * *